US007942576B2

(12) United States Patent
Zhao et al.

(10) Patent No.: US 7,942,576 B2
(45) Date of Patent: May 17, 2011

(54) ADJUSTING POSITIONER FOR RADIATION DEVICE

(75) Inventors: Ziran Zhao, Beijing (CN); Yuanjing Li, Beijing (CN); Wanlong Wu, Beijing (CN); Yulan Li, Beijing (CN); Xilei Luo, Beijing (CN); Bin Sang, Beijing (CN); Zhimin Zheng, Beijing (CN); Shuo Cao, Beijing (CN); Hailin Wang, Beijing (CN)

(73) Assignees: Tsinghua University, Beijing (CN); Nuctech Company Limited, Beijing (CN)

( * ) Notice: Subject to any disclaimer, the term of this patent is extended or adjusted under 35 U.S.C. 154(b) by 51 days.

(21) Appl. No.: 12/475,789

(22) Filed: Jun. 1, 2009

(65) Prior Publication Data

US 2009/0310751 A1 Dec. 17, 2009

(30) Foreign Application Priority Data

Jun. 12, 2008 (CN) ..... 2008 1 0114814

(51) Int. Cl.
*H05G 1/02* (2006.01)

(52) U.S. Cl. ..... 378/197; 378/167; 378/189; 378/193; 250/496.1; 250/522.1

(58) Field of Classification Search ..... 378/167, 378/189, 193, 197; 250/496.1, 522.1
See application file for complete search history.

(56) References Cited

U.S. PATENT DOCUMENTS

| | | | | |
|---|---|---|---|---|
| 3,549,885 | A * | 12/1970 | Andersson | 378/189 |
| 4,093,860 | A * | 6/1978 | Kelman et al. | 378/17 |
| 4,628,523 | A * | 12/1986 | Heflin | 378/193 |
| 4,651,007 | A * | 3/1987 | Perusek et al. | 250/363.08 |
| 4,907,157 | A * | 3/1990 | Uyama et al. | 382/131 |
| 5,469,429 | A * | 11/1995 | Yamazaki et al. | 378/19 |
| 5,541,856 | A * | 7/1996 | Hammermeister | 378/196 |
| 6,519,312 | B1 * | 2/2003 | Tybinkowski et al. | 378/4 |
| 7,190,758 | B2 * | 3/2007 | Hagiwara | 378/7 |
| 7,388,941 | B2 * | 6/2008 | Sukovic et al. | 378/19 |
| 7,396,160 | B2 * | 7/2008 | Tybinkowski et al. | 378/199 |

* cited by examiner

*Primary Examiner* — Edward J Glick
*Assistant Examiner* — Thomas R Artman
(74) *Attorney, Agent, or Firm* — Westman, Champlin & Kelly, P.A.

(57) ABSTRACT

The present invention relates to an adjusting positioner for a radiation device, comprising: a clamping device detachably connected to the radiation device to clamp said radiation device; a supporter to which said clamping device is connected and a slide path is defined therebetween, wherein the clamping device clamping said radiation device is movable along said slide path in a predetermined direction; and an adjusting device coupled with said clamping device so as to drive said clamping device to move along said slide path. Since the present invention employs above technical solution, it is easy to adjust the position of the radiation device for example, X-ray device, so that the precisely positioning for the radiation device is achieved and a satisfying positioning accuracy is able to obtain.

16 Claims, 5 Drawing Sheets

A direction

ADJUSTING POSITIONER FOR RADIATION DEVICE

The present application claims priority of Chinese patent application Serial No. 200810114814.2, filed Jun. 12, 2008, the content of which is hereby incorporated by reference in its entirety.

FIELD OF INVENTION

The present invention relates to a radiation detecting technical field, particularly, to a CT security inspection system, more particularly, to a radiation device for a CT security inspection system apparatus, for example, an adjusting positioner for an X-ray device.

BACKGROUND OF INVENTION

Presently, in the prior art which relates to the CT security inspection system generally comprises an X-ray device serving as a radiation source. The X-ray device emits the X-ray beam to scan the object to be inspected in the CT scanning channel. However, in the prior art, the device for fixing the X-ray device is not easy to adjust and the precision of the adjusting is poor. Also, since the collimator and the X-ray device are disposed separately, the conformability of the adjusting is bad and the structure of adjusting positioner for the X-ray device is caused to be large.

SUMMARY OF INVENTION

An object of the present invention is aimed to solve at least one aspect of above problems and defects existing in the prior art.

Accordingly, one object of the present invention is to provide an adjusting positioner for a radiation device, which is easy to adjust the position of the radiation device and has a satisfying adjusting precision.

Another object of the present invention is to provide an adjusting positioner for a radiation device, which is integrated with a collimator, so that the consistency of adjustment in the positions of the collimator and the radiation device are ensured and the structure thereof is compact.

According to one aspect of the present invention, there is provided an adjusting positioner for a radiation device, comprising: a clamping device detachably connected to the radiation device to clamp said radiation device; a supporter to which said clamping device is connected and a slide path is defined therebetween, wherein the clamping device clamping said radiation device is movable along said slide path in a predetermined direction; and an adjusting device coupled with said clamping device so as to drive said clamping device to move along said slide path.

In one embodiment, a first threaded portion is provided on said clamping device; and said adjusting device includes an adjusting screw mounted to the supporter, said adjusting screw has a second threaded portion, said first threaded portion on the clamping device is fitted with the second threaded portion of the adjusting screw to drive said clamping device to move along said slide path.

Preferably, said clamping device comprises a first cambered plate portion and a second cambered plate portion, said first and second cambered plate portions are securely fitted with each other so as to clamp said radiation device therebetween.

Furthermore, said first and second cambered plate portions respectively includes an arched portion and wing portions extending outwardly from two ends of said arched portion; said slide path is configured by a slid rail and a slide slot, said slid rail being disposed at an end surface of said wing portion provided on one of the first and second cambered plate portions, and said slide slot being provided on said supporter and fitted with said slide rail.

Further preferably, a first boss is provided on the first cambered plate portion, said first threaded portion is provided in the first boss; the supporter is provided with an upper and lower bosses having holes, said adjusting screw passes through said hole of the upper boss, said first threaded portion and said hole of the lower boss, and is restricted between the upper and lower bosses and rotatable about an axis of the adjusting screw.

In one embodiment, a second boss is formed on the arched portion of the second cambered plate portion, said second boss is formed therein with a boss opening through which the X-ray passes; said radiation device includes a beam outlet; said beam outlet is aligned with the boss opening in the second boss.

In one embodiment, said wing portion of any one of said first and second cambered plate portions is provided with a vertical elongate hole, said supporter is provided with a corresponding screw hole, when the radiation device is adjusted to a desired position, a fastening screw passes through the elongate hole and said screw hole so as to fix said radiation device with respect to said supporter.

According to one embodiment of the present invention, the adjusting positioner further comprises a collimator shaped in substantial sectorial box, said sectorial box including a wide end and a narrow end, wherein said narrow end of the sectorial box is formed with a third boss formed with a boss opening through which the X-ray passes; said third boss and the second boss are securely fitted with each other so that the boss opening in the second boss is aligned with the boss opening in the third boss.

Preferably, a horizontal position limiting rule is disposed at the lower end of the second boss, the vertical height from the boss opening in the second boss to said horizontal position limiting rule is equal to the vertical height from the beam outlet of the radiation device to the bottom of the radiation device, so that the boss opening of the second boss and the beam outlet of the radiation device are located at the same level when the bottom of the radiation comes into contact with the horizontal position limiting rule.

Preferably, the wide end of the sectorial box is formed with a horizontal long slot through which the radiation passes, said horizontal long slot is aligned with the beam outlet of the radiation device, boss openings of the second and third bosses.

Furthermore, said sectorial box is made of material preventing the radiation from penetrating therethrough or lined with material preventing the radiation from penetrating therethrough.

In one embodiment, a groove is provided on each side of the long slot at said wide end of the sectorial box, said groove is internally formed at an inner wall thereof with a vertical slot through which the radiation passes.

Furthermore, a circuit board having a detector is installed within said groove.

Further preferably, said first threaded portion is a threaded hole provided in the first boss.

In one embodiment, said second cambered plate portion is lined with material preventing the radiation from penetrating therethrough.

In one embodiment, an opening is formed between said upper and lower bosses; and said first boss passes through said opening to fit with said adjusting screw.

Since the present invention employs the above technical solution, it is easy to adjust the position of the radiation device for example, X-ray device, so that the precise positioning of the radiation device is achieved and a satisfying positioning accuracy is able to be obtained. Furthermore, according to another embodiment of the present invention, the collimator is integrated with the radiation device, so that the defect of complex and fussy adjustments required for the separate radiation device and collimator in the prior art is avoided.

BRIEF DESCRIPTION OF THE DRAWING

FIG. 1 is a perspective view of an embodiment of an adjusting positioner for a X-ray device combined with a collimator of the present invention, wherein

FIG. 5 is a perspective view of a supporter according to the embodiment of the present invention, wherein FIG. 6 is a perspective view of a sector-shaped collimator according to the embodiment of the present invention, wherein

DETAILED DESCRIPTION OF PREFERRED EMBODIMENTS

Figure 1A:
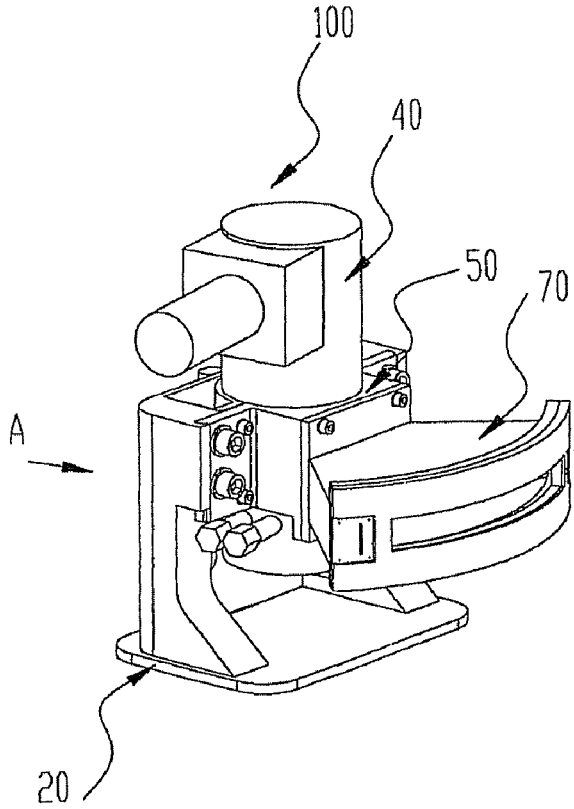
FIG. 1A is a schematic view showing the adjusting positioner for the X-ray device combined with the collimator.

Preferred embodiments of the present invention will be described hereinafter in detail with reference to the attached drawings, wherein the like reference numerals refer to the like elements throughout the specification. The present invention may, however, be embodied in many different forms and should not be construed as being limited to the embodiments set forth herein; rather, these embodiments are provided so that the present disclosure will be thorough and complete, and will fully convey the concept of the invention to those skilled in the art.

Figure 1B:
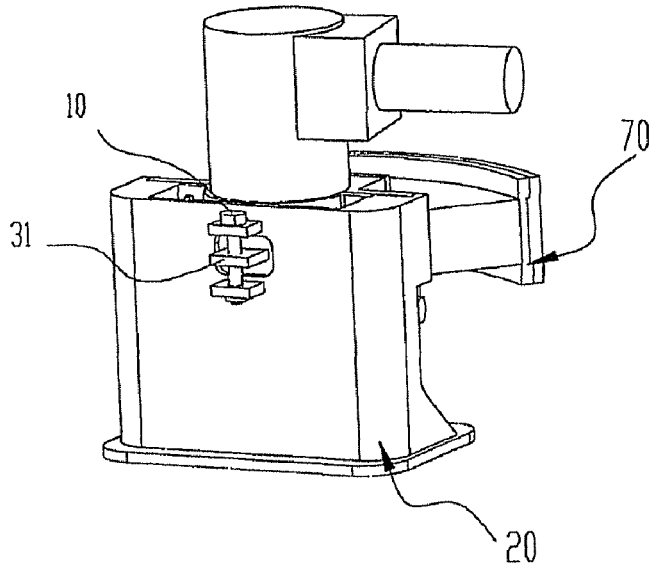
FIG. 1B is a view taken in the A direction in FIG. 1A which shows the adjusting positioner for the X-ray device.
Figure 2:
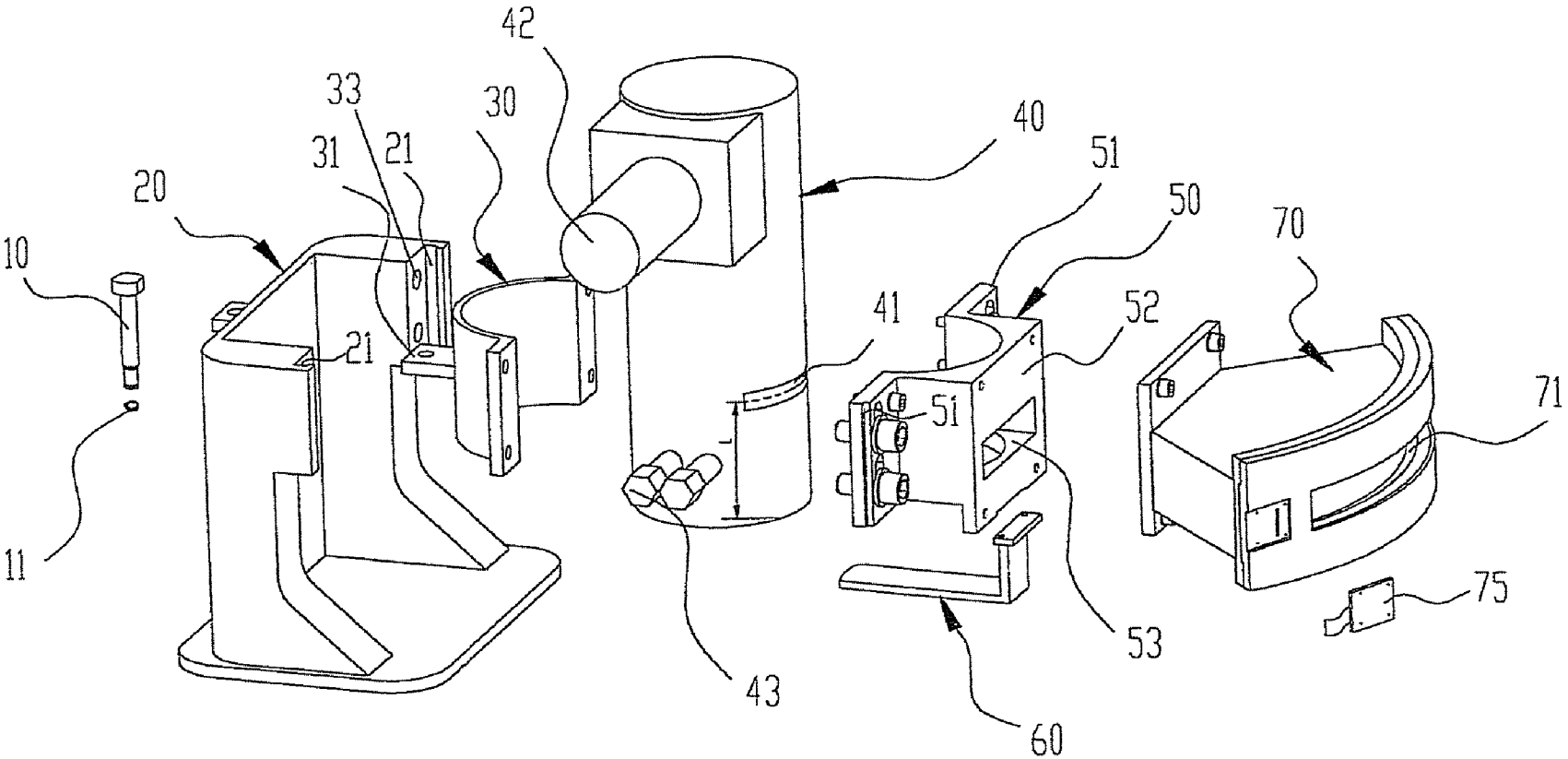
FIG. 2 is an explored perspective view of the adjusting positioner for the X-ray device combined with the collimator of FIG. 1.

Refer to FIGS. 1 and 2, an adjusting positioner 100 for an X-ray device according to an embodiment of the present invention includes: an adjusting screw 10 as an adjusting device; a supporter 20; an X-ray device 40 as a radiation device; a clamping device composed of a semicircular clamping plate 30 and a semicircular clamping plate 50. The clamping device composed of the semicircular clamping plate 30 and the semicircular clamping plate 50 are detachably connected to the X-ray device 40 through for example, a bolt and a nut, to clamp the X-ray device 40.

Refer to FIG. 2, the X-ray device 40 has a substantially cylindrical shape, and comprises a high voltage power source 42 for supplying power to the X-ray device; a bulb tube 43 for generating an X-ray radiation, and a beam outlet 41 for emitting the X-ray radiation to the exterior.

Figure 5A:
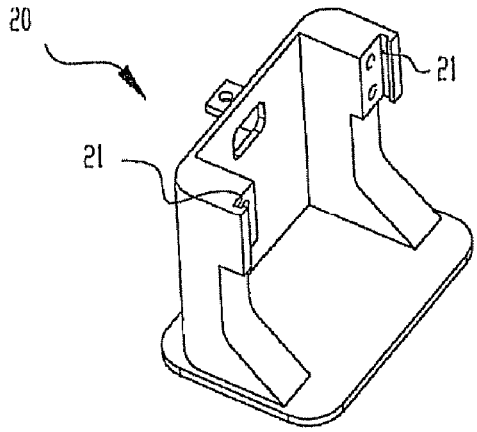
FIG. 5A is a schematic view showing a front side of the supporter.
Figure 5B:
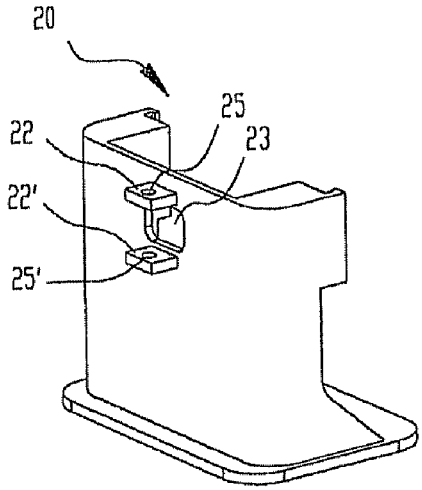
FIG. 5B is a schematic view showing rear side of the supporter.

Refer to FIGS. 2 and 5, the supporter has a substantial L-shaped frame shape, which has a vertical portion and a horizontal portion. The horizontal portion is supported on for example, a floor surface, to serve as a base of the adjusting positioner 100 for the X-ray device; in FIG. 2, a projection of the vertical portion on a horizontal plane has a substantial C-shape. The front surface of the C-shaped vertical portion is provided with an upper and lower bosses 22 and 22' horizontally extending therefrom (especially referring to the left side of FIG. 2 and FIG. 5B). A quadrate opening 23 passing through the vertical portion is provided between the upper and lower bosses 22 and 22'. Refer to FIG. 5B, the upper and lower bosses 22 and 22' are provided with holes 25 and 25' respectively. Refer to FIG. 2 and FIG. 5A, the opposing sides of the rear end surface (referring to right side of FIG. 2) of the C-shaped vertical portion are provided with a vertical guiding slide slot 21, respectively.

Figure 3:
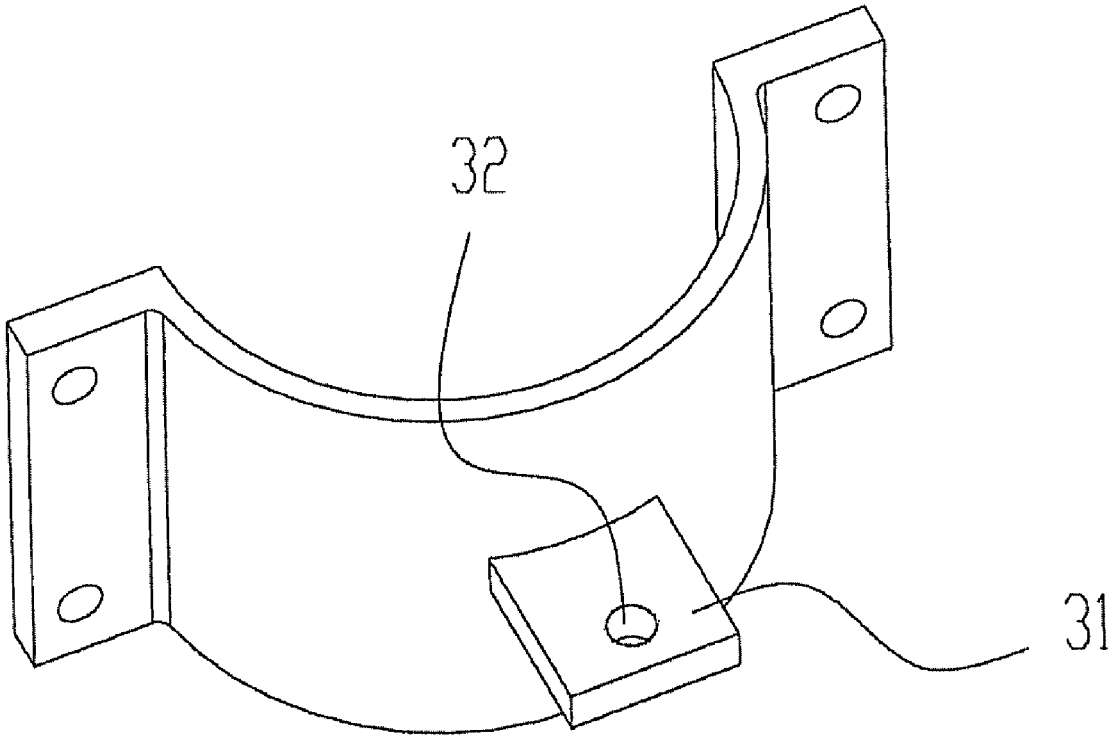
FIG. 3 is a perspective view of a semicircular clamping plate having short wing portions of a clamping device according to the embodiment of the present invention.
Figure 4:
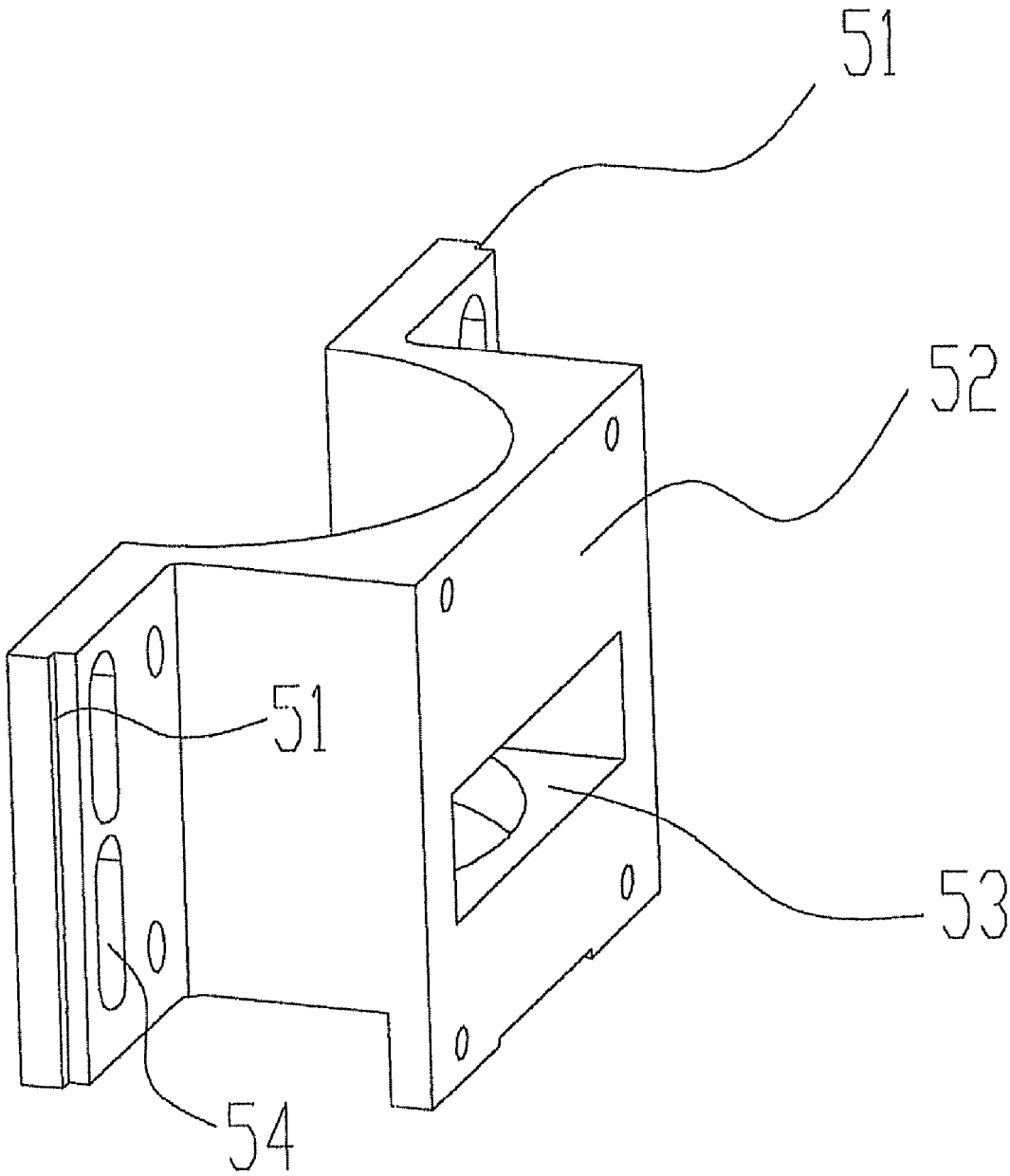
FIG. 4 is a perspective view of a semicircular clamping plate having long wing portions of the clamping device according to the embodiment of the present invention.

Refer to FIG. 2, in one embodiment, the clamping device is composed of a semicircular clamping plate 30 with short wing portions and a semicircular clamping plate 50 having long wing portions and a stage. Each of the semicircular clamping plates 30 and 50 comprises a cambered portion and wing portions extending outwardly from two ends of the cambered portion. In one embodiment, as shown in FIG. 2, the wing portions of the semicircular clamping plate 50 are longer than those of the semicircular clamping plate 30. Refer to FIG. 3, a boss 31 extending horizontally is provided on one side of the cambered portion of the semicircular clamping plate 30, and a threaded hole 32 is provided in the boss 31. In the assembly process, the boss 31 of the semicircular clamping plate 30 extends through the quadrate opening 23 of the vertical portion of the supporter 20. Refer to FIG. 4, a slide rail 51 is provided at each of end surfaces of the long wing portions of the semicircular clamping plate 50.

As shown in FIG. 1, the slide rails 51 at the long wing portions extending from the semicircular clamping plates 30 and 50 are embedded in the vertical guiding slide slots 21 of the supporter 20, respectively. Thereby, the clamping device is connected to the supporter 20 and one sliding path defined by both the slide rails 51 and the vertical guiding slide slots 21 is defined between the clamping device and the supporter 20. Therefore, the clamping device clamping the X-ray device 40 is able to move along the sliding path in a vertical direction. Although in the above embodiment, the slide rails 51 are provided on the end surfaces of the wing portions of the semicircular clamping plate 50, the present invention is not limited thereto. For example, the slide rails may be provided on the end surfaces of the wing portions of the semicircular clamping plate 30.

Refer to FIGS. 1B and 2, the adjusting screw 10 as the adjusting device is provided with a threaded portion thereon, and passes through the hole 25 in the upper boss 22, the threaded hole 32 in the boss 31 passing through the quadrate opening 23 of the vertical portion of the supporter 20, and the hole 25' of the lower boss 22'. The adjusting screw 10 is restricted between the upper and lower bosses 22 and 22' and is rotatable about an axis thereof. At the same time, the threaded portion of the adjusting screw 10 is fitted with the threaded hole 32 in the boss 31 so as to drive the clamping device to move along the sliding path. Furthermore, as shown in FIGS. 1, 2, and 5, the adjusting device further comprises a locating washer 11, which is used for restricting the adjusting screw 10 between the upper boss 22 and the lower boss 22' after the adjusting screw 10 passes through the hole 25 of the upper boss 22, the threaded hole 32 in the boss 31 and the hole 25' of the lower boss 22'. Alternatively, the washer 11 can be replaced with other locating devices, for example, a locating clip.

Furthermore, vertical elongate holes 54 are provided on the wing portions of the semicircular clamping plate 50; and meanwhile, screw holes 33 corresponding to the vertical elongate holes 54 of the semicircular clamping plate 50 are provided in the supporter 20. After the X-ray device 40 moves to the desired location through the clamping device, fastening screws pass through the vertical elongate holes 54 of the semicircular clamping plate 50 and the screw holes 33 provided in the supporter 20 such that the X-ray device 40 is fixed in the vertical direction with respect to the supporter. When the X-ray device 40 is required to re-adjust, the fastening screw is unscrewed from the screw hole 33. Therefore, when the adjusting screw 10 drives the clamping device clamping the X-ray device 40 to move along the slide path, the fastening screws are synchronously moved within the vertical elongate holes 54 in the vertical direction as shown in FIG. 2. Although in the above description, the X-ray 40 is fixed against the supporter 20 by means of the screws and the screw holes 33 provided in the supporter 20 as shown in FIG. 2. Apparently, the present invention may employ other alternative embodiments, for example, the engagement of the bolt and the nut.

Refer to FIG. 4, an arched section of the semicircular clamping plate 50 is formed with a second boss 52 in which a boss opening 53 for allowing the X-ray to pass therethrough is formed. At the same time, the X-ray device 40 comprises a beam outlet 41. In use, the beam outlet 41 is aligned with the boss opening 53 in the second boss 52. Refer to FIG. 2, in the present invention, terminology "be aligned or alignment" means that the horizontal central line of the beam outlet 41 and the horizontal central line of the boss opening 53 in the second boss 52 are located at the same level. In one embodiment, the inside of the semicircular clamping plate 50 is lined with a material preventing the radiation from penetrating therethrough, so that the radiation is prevented from leaking to the external environment.

Refer to FIG. 2, one horizontal position limiting rule 60 is provided at the lower end of the second boss 52, the horizontal position limiting rule 60 is bent in an L shape, and connected to the lower end of the second boss 52 through for example, a screw. The vertical height from the boss opening 53 of the second boss 52 to the horizontal position limiting rule 60 is equal to the vertical height L between the beam outlet 41 of the X-ray device and the bottom of the X-ray device, so that the boss opening 53 of the second boss 52 and the beam outlet 41 of the X-ray device 40 are located at the same level when the bottom of the X-ray device come in contact with the horizontal position limiting rule 60.

Figure 6A:
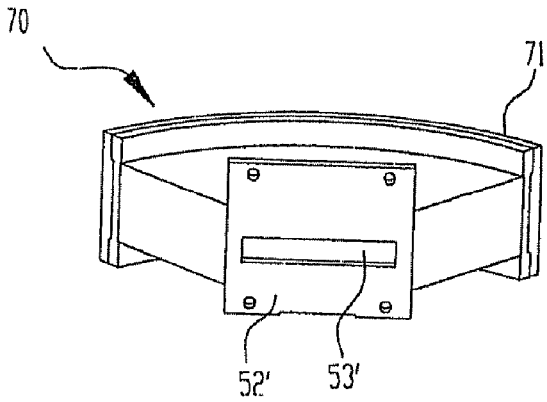
FIG. 6A is a perspective view showing the side where the boss 52' of the sector-shaped collimator is provided.

According to one embodiment of the present invention, the adjusting positioner 100 for the X-ray device further comprises: a collimator 70 shaped in substantial sectorial box having a wide end and a narrow end. Refer to FIG. 6A, the narrow end of the sectorial box 70 is formed with a boss 52' in which a boss opening 53' is formed, the X-ray passes through the boss opening 53'. The boss 52' and the boss 52 of the semicircular clamping plate 50 are securely fitted with each other through for example, a screw, so that the boss opening 53 in the boss 52 is aligned with the boss opening 53' in the boss 52'. The wide end 71 of the sectorial box is formed with a horizontal long slot 72 through which the X-ray passes, and the long slot 72 is aligned with the beam outlet 41 of the X-ray, the boss openings 53, 53' of the bosses 52, 52'. As described above, in the present invention terminology "be aligned or alignment" means that horizontal central lines of the beam outlet 41 of the X-ray device, the boss openings 53, 53' of the bosses 52, 52', and the horizontal long slot 72 of the wide end 71 of the sectorial box are located at the same level. In one embodiment, the sectorial box is made of material preventing the radiation from the penetrating therethrough or lined with material preventing the radiation from penetrating therethrough, so that the radiation is prevented from leaking to the external environment.

Figure 6B:
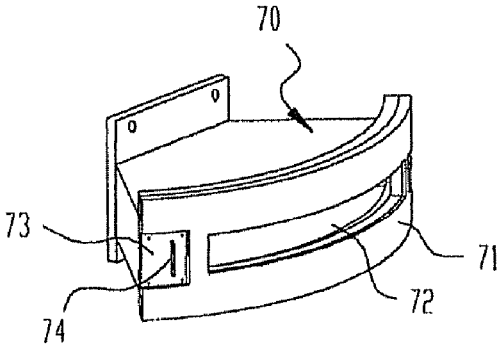
FIG. 6B is a perspective view showing the side of the wide end 71 of the sector-shaped collimator.

Refer to FIGS. 6B and 2, grooves 73 are respectively provided at the wide end 71 of the sectorial box on both sides of the long slot 72. Each underside of the grooves 73 is formed therein with a vertical slot 74 through which the radiation passes. Circuit boards 75 which are used for luminance correction and have a detector are installed within the groove 73, respectively. In this way, during the correction of the luminance by means of the detector, a part of X-ray passes through the slots 74 on the sectorial box and projects onto the detectors in front of the circuit boards 75. The radiation signals from the detectors are detected through the circuit boards 75 so that the luminance of the X-ray device is corrected.

Hereafter, the assembly and the operation process of the adjusting positioner for the X-ray device in the present invention is briefly described by referring to FIGS. 1-6.

Two semicircular clamping plates 30, 50 clamp the X-ray device 40 through bolts. During the process of clamping the X-ray device 40, firstly, the horizontal position limiting rule 60 is connected to the lower end of the boss 52 of the semicircular clamping plate 50, and the X-ray device 40 is moved in the vertical direction. When the bottom of the X-ray device 40 comes into contact with the upper surface of the horizontal position limiting rule 60, since the vertical height from the boss opening 53 of the second boss 52 to the horizontal position limiting rule 60 is equal to the vertical height L between the beam outlet 41 of the X-ray device and the bottom of the X-ray device, the boss opening 53 of the second boss 52 and the beam outlet 41 of the X-ray device 40 are located at the same level so as to be aligned with each other.

After the boss opening 53 of the second boss 52 and the beam outlet 41 of the X-ray device 40 are aligned with each other, the semicircular clamping plates 30 and 50 are securely connected to each other by means of connection of the bolt and the nut, so that the X-ray device 40 is stably clamped therebetween. The slide rails 51 at the ends of the long wing portions extending from two assembled semicircular clamping plates 30 and 50 are embedded into the vertical guiding slide slots 21 of the supporter 20, and at the same time, the boss 31 with the screw hole 32 extending from the semicircular clamping plate 30 with the short wing portion passes through the opening 23 of the supporter 20, the adjusting screw 10 passes through the hole 25 of the upper boss 22, the screw hole 32 in the boss 31 and the hole 25' of the lower boss 22', and is restricted between the upper and lower bosses 22 and 22' by the position limiting washer 11.

Furthermore, the boss 52' of the collimator 70 shaped in sectorial box is securely connected with the boss 52 of the semicircular clamping plate 50 through for example, the bolt and the nut, so that the boss opening 53 in the boss 52 is aligned with the boss opening 53' in the boss 52'. Thereby, the beam outlet 41 of the X-ray device, boss openings 53, 53' in the bosses 52, 52' as well as the horizontal elongate slot 72 of the wide end 71 of the sectorial box are located at the same level, that is, alignment therebetween is achieved.

Then, through rotating the adjusting screw 10 coupled with the boss 31 of the semicircular clamping plate 30, through the thread engagement between the threaded portion of the screw 10 and the threaded hole 33 within the boss 31, the clamping device is driven to move up and down, so that the X-ray device 40 clamped by the clamping device is driven to move up and down, so that the purpose of adjustment of the X-ray device is realized. The precision accuracy for rising and declining the X-ray device 40 is well adjustable by setting the thread pitch of the threaded portions of the adjusting screw 10 and the threaded hole 32.

When the X-ray device 40 is adjusted to the desired position in the vertical direction, as shown in FIG. 2, the fastening screw is passed through the vertical elongate hole 54 of the semicircular clamping plate 50 and is screwed in the screw hole 33 provided in the supporter 20, so that the X-ray device 40 is fixed against the supporter 20 in the vertical direction. When the position of the X-ray device 40 is required to re-adjust, the fastening screw is unscrewed from the screw hole 33 and then the X-ray device 40 is driven by screwing the adjusting screw 10 to move up and down in respect to the supporter 20 in the vertical direction. When the clamping device clamping the X-ray device 10 driven by the adjusting screw 10 moves along the slide path, as shown in FIG. 2, the fastening screw is synchronistically moved within the vertical elongate hole 54 in the vertical direction.

Furthermore, although in the present invention, the adjusting positioner according to the present invention is described by the example which uses the X-ray device as a radiation source, the present invention is not limited thereto, other alternative radiation devices are also can be employed, for example, an isotope radiation source and the like. Although in the present invention, the adjustment of X-ray device in respect to the supporter is described by taking the horizontal and vertical directions as the example, the present invention is not limited thereto, and the directions can be any proper directions.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An adjusting positioner for a radiation device, comprising:

a clamping device detachably connected to the radiation device to clamp said radiation device;

a supporter to which said clamping device is connected and a slide path is defined therebetween, wherein the clamping device clamping said radiation device is movable along said slide path in a predetermined direction;

an adjusting device coupled with said clamping device so as to drive said clamping device to move along said slide path;

said clamping device comprises a first cambered plate portion and a second cambered plate portion, said first and second cambered plate portions are securely fitted with each other so as to clamp said radiation device therebetween;

each of said first and second cambered plate portions includes an arched portion and wing portion extending outwardly from two ends of said arched portion;

said slide path is composed of slide rails and slide slots, said slide rails being disposed at end surfaces of said wing portions of one of the first and second cambered plate portions; and said slide slots being provided on said supporter and fitted with said slide rails.

2. The adjusting positioner for the radiation device as claimed in claim 1, wherein:

a first threaded portion is provided in said clamping device; and said adjusting device includes an adjusting screw mounted to the supporter, said adjusting screw has a second threaded portion, said first threaded portion in the clamping device is fitted with the second threaded portion of the adjusting screw to drive said clamping device to move along said slide path.

3. The adjusting positioner for the radiation device as claimed in claim 1, wherein:

a first boss is provided on the first cambered plate portion, said first threaded portion is provided in the first boss;

the supporter is provided with an upper and lower bosses having holes, said adjusting screw passes through said hole of the upper boss, said first threaded portion and said hole of the lower boss, and is restricted between the upper and lower bosses and rotatable about an axis thereof.

4. The adjusting positioner for the radiation device as claimed in claim 3, wherein:

a second boss is formed on the arched portion of the second cambered plate portion, said second boss is formed therein with a boss opening through which the X-ray passes;

said radiation device includes a beam outlet;

said beam outlet is aligned with the boss opening in the second boss.

5. The adjusting positioner for the radiation device as claimed in claim 4, further comprising:

a collimator shaped in substantial sectorial box, said sectorial box including a wide end and a narrow end, wherein said narrow end of the sectorial box is formed with a third boss formed with a boss opening through which the X-ray passes;

said third boss and the second boss are securely fitted with each other so that the boss opening in the second boss is aligned with the boss opening in the third boss.

6. The adjusting positioner for the radiation device as claimed in claim 5, wherein:

said wide end of the sectorial box is formed with a horizontal long slot through which the radiation passes, said horizontal long slot is aligned with the beam outlet of the radiation device, the boss openings of the second and third bosses.

7. The adjusting positioner for the radiation device as claimed in claim 6, wherein:

grooves are provided at said wide end of the sectorial box on both sides of the long slot respectively, each underside of said grooves is internally formed with a vertical slot through which the radiation passes.

8. The adjusting positioner for the radiation device as claimed in claim 7, wherein:

a circuit board having a detector is installed within each of said grooves.

9. The adjusting positioner for the radiation device as claimed in claim 5, wherein:

said sectorial box is made of material preventing the radiation from penetrating therethrough or lined with material preventing the radiation from the penetrating therethrough.

10. The adjusting positioner for the radiation device as claimed in claim 4, wherein:

a horizontal position limiting rule is connected to the lower end of the second boss, the vertical height from the boss opening in the second boss to said horizontal position limiting rule is equal to the vertical height from the beam outlet of the radiation device to the bottom of the radiation device, so that the boss opening of the second boss and the beam outlet of the radiation device are located at the same level when the bottom of the radiation device comes into contact with the horizontal position limiting rule.

11. The adjusting positioner for the radiation device as claimed in claim 3, wherein:

said first threaded portion is a threaded hole provided in the first boss.

12. The adjusting positioner for the radiation device as claimed in claim 3, wherein:

an opening is formed between said upper and lower bosses; and said first boss passes through said opening to fit with said adjusting screw.

13. The adjusting positioner for the radiation device as claimed in claim 1, wherein:

said wing portions of one of said first and second cambered plate portions are provided with vertical elongate holes, said supporter is provided with corresponding screw holes, when the radiation device is adjusted to a desired position, fastening screws pass said screw holes so as to fix said radiation device in respect to said supporter.

14. The adjusting positioner for the radiation device as claimed in claim 1, wherein:

said second cambered plate portion is lined with material preventing the radiation from penetrating therethrough.

15. The adjusting positioner for the radiation device as claimed in claim 1, wherein:

said radiation device is an X-ray device.

16. The adjusting positioner for the radiation device as claimed in claim 1, wherein:

said radiation device is an isotope radiation source.

* * * * *